US005727572A

United States Patent [19]

Gillie

[11] Patent Number: 5,727,572

[45] Date of Patent: Mar. 17, 1998

[54] CIGARETTE EXTINGUISHING DEVICE

[76] Inventor: Glenn Freeman Gillie, 5717 Hawthorne La., Portsmouth, Va. 23703

[21] Appl. No.: 802,786

[22] Filed: Feb. 18, 1997

[51] Int. Cl.[6] ..... A24F 19/14

[52] U.S. Cl. ..... 131/235.1; 131/237

[58] Field of Search ..... 131/235.1, 237, 131/256, 234, 236, 238

[56] References Cited

U.S. PATENT DOCUMENTS 4,595,905 6/1986 May ..... 131/309.15
5,598,854 2/1997 Gillie ..... 131/235.1

*Primary Examiner*—Vincent Millin
*Assistant Examiner*—Robert N. Wieland

[57] ABSTRACT

A cigarette extinguishing device including an extinguishing means. The extinguishing means has a snuff pad and an top for mechanically compressing a burning end of a cigarette therebetween to extinguish combustion. The snuff pad has a flat upper portion with a post projecting upwardly therefrom. The snuff pad has a flat lower portion with an opening defining a cavity within the snuff pad. Also, a bore hole is passed through the post and is in receipt of a bias spring. Lastly, the top has a flat upper portion, a flat lower portion and an outer periphery and a post receiving opening within. The post receiving opening is in receipt of the post and spring of the snuff pad. The top, when seated on the post, is capable of moving upwardly and downwardly when an individual engages the flat upper portion of the top.

10 Claims, 2 Drawing Sheets

CIGARETTE EXTINGUISHING DEVICE

BACKGROUND OF THE INVENTION

1. Field of the Invention

The present invention relates to a cigarette extinguishing device and more particularly pertains to providing an extinguisher for a burning cigarette that can be easily placed in most conventional table and automobile ashtrays.

2. Description of the Prior Art

The use of a cigarette extinguisher is known in the prior art. More specifically, cigarette extinguishers heretofore devised and utilized for the purpose of snuffing out burning cigarettes are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,984,586 to Nae-Won discloses an ashtray having a cigarette snuffing device. U.S. Pat. No. 4,660,575 to Andreason and Bingham discloses a cigarette extinguisher. U.S. Pat. No. 4,497,329 to O'Dell discloses a cigarette snuffer. U.S. Pat. No. e,937,229 to Wickstrom discloses a method for extinguishing cigarettes and apparatus. U.S. Pat. No. 3,871,387 to Busse discloses an ashtray. U.S. Pat. No. 3,620,226 to Ellerston discloses an extinguishing ashtray. U.S. Pat. No. 2,908,281 to Jacobs et al. discloses a cigarette ashtray and snubber. Lastly, U.S. Pat. No. 2,555,716 to Todhunter discloses an automatically lighted as receptacle.

In this respect, the cigarette extinguishing device according to the present invention substantially departs from the conventional concepts and designs of the prior art, and in so doing provides an apparatus primarily developed for the purpose of providing an extinguisher for a burning cigarette that can be easily placed in most conventional table and automobile ashtrays.

Therefore, it can be appreciated that there exists a continuing need for a new and improved cigarette extinguishing device which can be used for providing an extinguisher for a burning cigarette that can be easily placed in most conventional table and automobile ashtrays. In this regard, the present invention substantially fulfills this need.

SUMMARY OF THE INVENTION

In view of the foregoing disadvantages inherent in the known types of cigarette extinguishers now present in the prior art, the present invention provides an improved cigarette extinguishing device. As such, the general purpose of the present invention, which will be described subsequently in greater detail, is to provide a new and improved cigarette extinguishing device which has all the advantages of the prior art and none of the disadvantages.

To attain this, the present invention essentially comprises an extinguishing means that a snuff pad and an top for mechanically compressing a burning end of a cigarette therebetween to extinguish combustion. The snuff pad is generally conical in shape with an outer periphery. The snuff pad has a flat upper portion interconnected to the outer periphery. The flat upper portion has a post projecting upwardly therefrom and symmetrically spaced from the outer periphery. The snuff pad has a flat lower portion with an opening defining a cavity within the snuff pad. Also, a bore hole is passed through the post and exits into the cavity of the snuff pad. The bore hole has an increasing diameter with the greatest portion of the diameter near a free end of the post. The greatest portion of the diameter of the bore hole receives a bias spring. The bias spring has a portion projecting a distance above the free end of the post. Additionally, the top of the extinguishing means is generally conical in shape. The top has a flat upper portion, a flat lower portion and an outer periphery. Included is a post receiving opening that is centrally positioned within the top. A threaded opening is within the top and adjacent the post receiving opening. The post receiving opening is in receipt of the post and spring of the snuff pad. The top, when seated on the post, is capable of downward movement toward the snuff pad when an individual applies pressure to the flat upper portion of the top. The top, when seated on the post, is capable of upward movement by uncoiling of the bias spring when the individual releases the pressure on the flat upper portion of the top. The flat lower portion of the top and the flat upper portion of the snuff pad are flush when the top is pressed downwardly by the individual. Lastly, an ashtray means is provided. The ashtray means receives ashes from the burning end of the cigarette extinguished between the snuff pad and the top. The ashtray means has a base wall and a perimeter side wall projecting upwardly from an outer periphery of the base wall. The base wall of the ashtray means receiving the flat lower portion of the snuff pad to allow use of the extinguishing means within the ashtray means.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cigarette extinguishing device which has all the advantages of the prior art cigarette extinguishers and none of the disadvantages.

It is another object of the present invention to provide a new and improved cigarette extinguishing device which may be easily and efficiently manufactured and marketed.

It is a further object of the present invention to provide a new and improved cigarette extinguishing device which is of a durable and reliable construction.

An even further object of the present invention is to provide a new and improved cigarette extinguishing device which is susceptible of a low cost of manufacture with regard to both materials and labor, and which accordingly is then susceptible of low prices of sale to the consuming public, thereby making such cigarette extinguishing device economically available to the buying public.

Still yet another object of the present invention is to provide a new and improved cigarette extinguishing device which provides in the apparatuses and methods of the prior art some of the advantages thereof, while simultaneously overcoming some of the disadvantages normally associated therewith.

Still another object of the present invention is to providing an extinguisher for a burning cigarette that can be easily placed in most conventional table and automobile ashtrays.

Lastly, it is an object of the present invention to provide a new and improved extinguishing means that has a snuff pad and an top for mechanically compressing a burning end of a cigarette therebetween to extinguish combustion. The snuff pad has a flat upper portion with a post projecting upwardly therefrom. The snuff pad has a flat lower portion with an opening defining a cavity within the snuff pad. Also, a bore hole is passed through the post and is in receipt of a bias spring. Lastly, the top has a flat upper portion, a flat lower portion and an outer periphery and a post receiving opening within. The post receiving opening is in receipt of the post and spring of the snuff pad. The top, when seated on the post, is capable of moving upwardly and downwardly when an individual engages the flat upper portion of the top.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
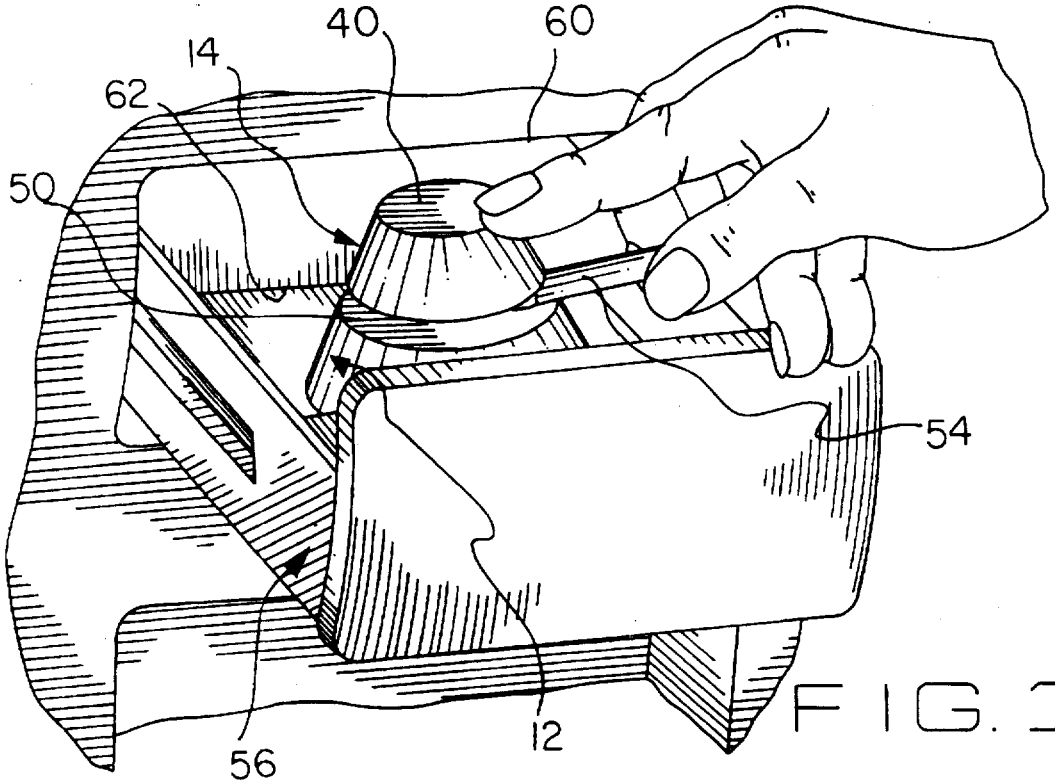
FIG. 1 is a perspective illustration of the preferred embodiment of the cigarette extinguishing device constructed in accordance with the principles of the present invention.

With reference now to the drawings, and in particular to FIG. 1 thereof, a new and improved cigarette extinguishing device embodying the principles and concepts of the present invention and generally designated by the reference numeral 10 will be described.

The present invention, the new and improved cigarette extinguishing device, is comprised of a plurality of components. Such components in their broadest context include a snuff pad, a top and a bias spring. Such components are individually configured and correlated with respect to each other so as to attain the desired objective.

Figure 2:
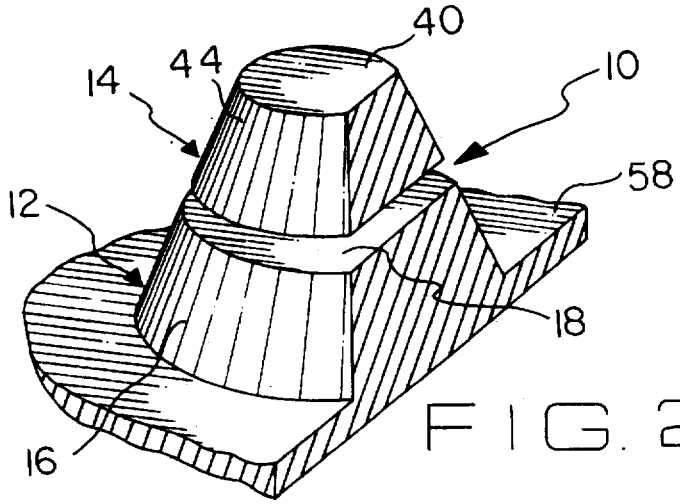
FIG. 2 is a sectional view of the extinguishing means of the present invention.
Figures 3, 4, 5:
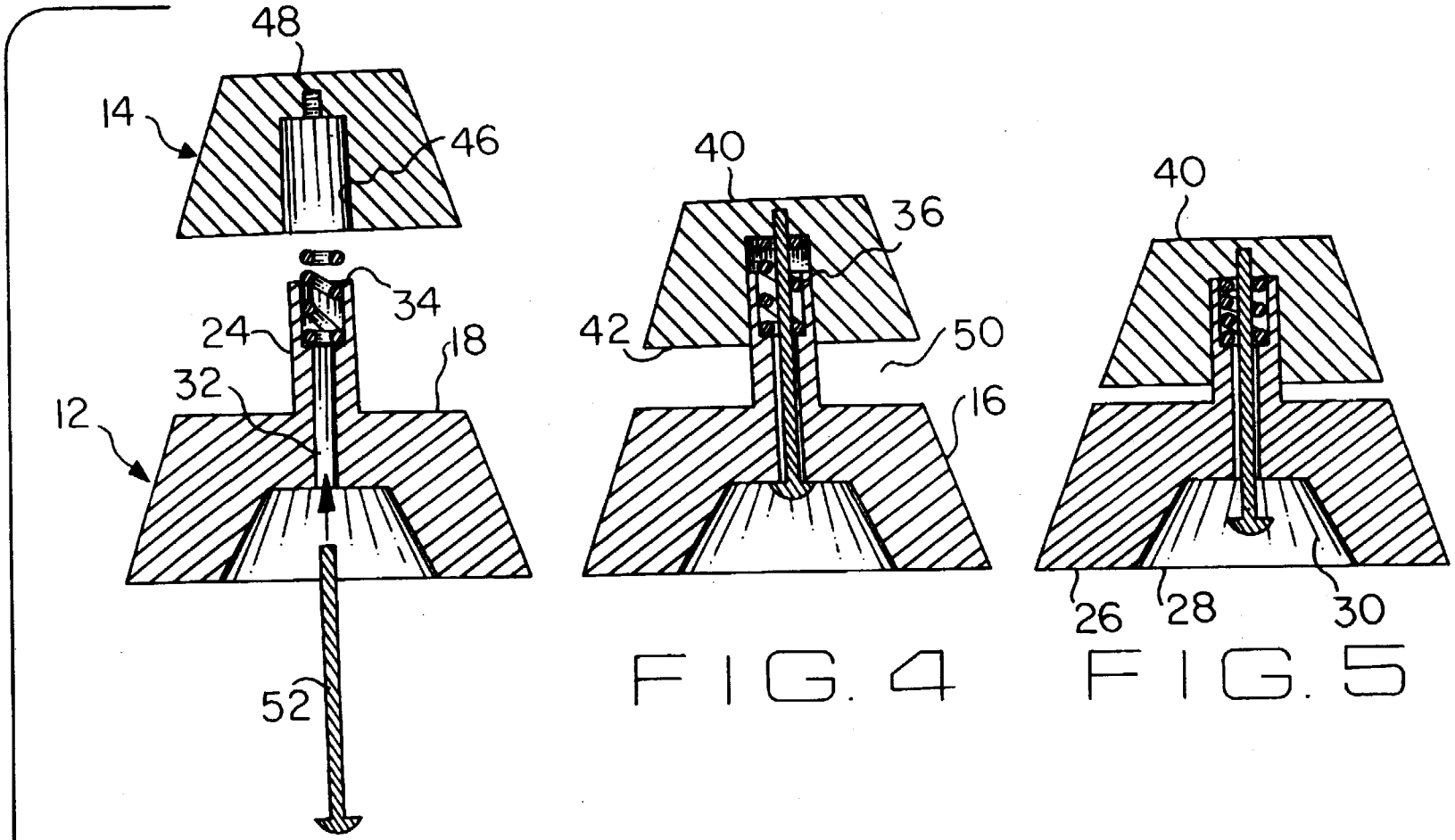
FIG. 3 is an exploded view of the components of the present invention.
FIG. 4 is a side elevational view of the present invention with the spring in an noncompressed state.
FIG. 5 is a side elevational view of the present invention with the spring in a compressed state.

More specifically, the present invention includes an extinguishing means 10. The extinguishing means has a snuff pad 12 and an top 14 for mechanically compressing a burning end of a cigarette therebetween to extinguish combustion. The snuff pad and the top are each made of a rigid plastic that is normally used in ashtrays. As seen in FIG. 2, the snuff pad is generally conical in shape with an outer periphery, the snuff pad having a flat upper portion interconnected to the outer periphery 16. The flat upper portion, as shown in FIG. 3, has a post 24 projecting upwardly therefrom. The post is symmetrically spaced from the outer periphery. The snuff pad has a flat lower portion 26. As depicted in FIG. 5, the flat lower portion of the snuff pad has an opening 28 that defines a cavity 30 within the snuff pad.

As best illustrated in FIG. 3, a bore hole is shown passing through the post and exiting into the cavity of the snuff pad. The bore hole has an increasing diameter with the greatest portion of the diameter being near a free end 34 of the post 24. The greatest portion of the diameter of the bore hole receives a bias spring 36. The bias spring has a portion projecting a distance above the free end of the post.

Also, the top 14 of the extinguishing means is generally conical in shape. The shape and size of the top is for fitting into the cavity of the snuff pad to allow several of the extinguishing means to be stacked. The top has a flat upper portion 40, a flat lower portion 42 and an outer periphery 44. FIG. 3, shows a post receiving opening 46 centrally positioned within the top. A threaded opening 48 is within the top and adjacent the post receiving opening. The post receiving opening is in receipt of the post and spring of the snuff pad when the top is seated on the snuff pad. A gap 50 is formed between the top and snuff pad when the top is seated on the snuff pad.

Additionally, a screw 52 is positioned within the bore hole. The screw enters the bore hole from the cavity. The screw threadedly engages the threaded opening 48 for coupling the top and the snuff pad. The top, when seated on the post, is capable of downward movement toward the snuff pad when an individual, as seen in FIG. 1, applies pressure to the flat upper portion 40 of the top. When pressure is applied the screw moves down within the bore hole with the movement of the top. FIG. 5 shown the position of the top and screw when in the down orientation. The top, when seated on the post, is capable of upward movement by the uncoiling of the bias spring 36 when the individual releases the pressure on the flat upper portion of the top. FIG. 4 shown the position of the top and screw when the pressure is released. The flat lower portion of the top and the flat upper portion of the snuff pad are almost flush when the top is pressed downwardly by the individual. The burning end of the cigarette 54 is positioned between the gap 50 when the top is in the up orientation. The top is pressed down and the burning end is crushed between the lower flat portion of the top and the upper flat portion of the snuff pad.

Lastly, an ashtray means 56 is provided. With this application the astray is an automobile ashtray. It is to be understood that the invention is not limited to use in an automobile. The ashtray means receives ashes from the burning end of the cigarette extinguished between the snuff pad and the top. The ashtray means, as shown in FIG. 1, has a base wall 58 and a perimeter side wall 60 projecting upwardly from an outer periphery 62 of the base wall. The base wall of the ashtray means receives the flat lower portion of the snuff pad to allow use of the extinguishing means within the ashtray means. The base wall and the snuff pad may be interconnected, as shown in FIG. 2, or non-connected.

The present invention cigarette extinguishing device is comprised of an extinguishing means that has a top and a snuff pad. The extinguishing means is positioned within the center of most commercially available ashtrays. The extinguishing means is spring loaded to allow up and down movement of the top about the snuff pad. A screw is provided to couple the top and snuff pad. The screw in nonrestrictive and moves up and down as the top is moved up and down about the post of the snuff pad.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved cigarette extinguishing device for crushing the lit end of a cigarette comprising in combination:

an extinguishing means having a snuff pad and an top for mechanically compressing a burning end of a cigarette therebetween to extinguish combustion therewithin, the snuff pad being generally conical in shape with an outer periphery, the snuff pad having a flat upper portion interconnected to the outer periphery, the flat upper portion having a post projecting upwardly therefrom and symmetrically spaced from the outer periphery, the snuff pad having a flat lower portion with an opening defining a cavity within the snuff pad;

a bore hole being passed through the post and exiting into the cavity of the snuff pad, the bore hole having an increasing diameter with the greatest portion of the diameter being near a free end of the post, the greatest portion of the diameter of the bore hole receiving a bias spring, the bias spring having a portion projecting a distance above the free end of the post;

the top of the extinguishing means being generally conical in shape, the top having a flat upper portion, a flat lower portion and an outer periphery, a post receiving opening being centrally positioned within the top, a threaded opening being within the top and adjacent the post receiving opening, the post receiving opening being in receipt of the post and spring of the snuff pad, the top when seated on the post being capable of downward movement toward the snuff pad when an individual applies pressure to the flat upper portion of the top, the top when seated on the post being capable of upward movement by uncoiling of the bias spring when the individual releases the pressure on the flat upper portion of the top, the flat lower portion of the top and the flat upper portion of the snuff pad being flush when the top being pressed downwardly by the individual; and an ashtray means for receiving ashes from the burning end of the cigarette extinguished between the snuff pad and the top, the ashtray means having a base wall and a perimeter side wall projecting upwardly from an outer periphery of the base wall, the base wall of the ashtray means receiving the flat lower portion of the snuff pad to allow use of the extinguishing means within the ashtray means.

2. A cigarette extinguishing device comprising:

an extinguishing means having a snuff pad and an top for mechanically compressing a burning end of a cigarette therebetween to extinguish combustion therewithin, the snuff pad having a flat upper portion with a post projecting upwardly therefrom, the snuff pad having a flat lower portion with an opening defining a cavity within the snuff pad;

a bore hole being passed through the post and in receipt of a bias spring; and the top having a flat upper portion, a flat lower portion and an outer periphery and a post receiving opening within, the post receiving opening being in receipt of the post and spring of the snuff pad, the top when seated on the post being capable moving upwardly and downwardly when an individual engages the flat upper portion of the top.

3. The cigarette extinguishing device as set forth in claim 2, wherein the snuff pad being generally conical in shape with an outer periphery, and the snuff pad having a flat upper portion interconnected to the outer periphery.

4. The cigarette extinguishing device as set forth in claim 2, wherein the bore hole exiting into the cavity of the snuff pad and having an increasing diameter with the greatest portion of the diameter being near a free end of the post.

5. The cigarette extinguishing device as set forth in claim 4, wherein, the greatest portion of the diameter of the bore hole receiving the bias spring, and the bias spring having a portion projecting a distance above the free end of the post when positioned within the bore hole.

6. The cigarette extinguishing device as set forth in claim 2, wherein the top of the extinguishing means being generally conical in shape and a threaded opening being within the top and adjacent the post receiving opening of the top.

7. The cigarette extinguishing device as set forth in claim 2, wherein the top when seated on the post of the snuff pad being capable of a downward movement toward the snuff pad when an individual applies pressure to the flat upper portion of the top.

8. The cigarette extinguishing device as set forth in claim 7, wherein the top when seated on the post being capable of upward movement by uncoiling of the bias spring when the individual releases the pressure on the flat upper portion of the top, and the flat lower portion of the top and the flat upper portion of the snuff pad being flush when the top being pressed downwardly by the individual.

9. The cigarette extinguishing device as set forth in claim 2, further including an ashtray means for receiving ashes from the burning end of the cigarette extinguished between the snuff pad and the top.

10. The cigarette extinguishing device as set forth in claim 9, wherein the ashtray means having a base wall and a perimeter side wall projecting upwardly from and outer periphery of the base wall, and the base wall of the ashtray means receiving the flat lower portion of the snuff pad to allow use of the extinguishing means within the ashtray means.

* * * * *